US007703293B2

(12) United States Patent
An et al.

(10) Patent No.: US 7,703,293 B2
(45) Date of Patent: Apr. 27, 2010

(54) REFRIGERATOR AND OPERATING METHOD THEREOF

(75) Inventors: Jae-koog An, Gwangju (KR); Jae-ki Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 350 days.

(21) Appl. No.: 11/980,388

(22) Filed: Oct. 31, 2007

(65) Prior Publication Data

US 2008/0314054 A1 Dec. 25, 2008

(30) Foreign Application Priority Data

Jun. 11, 2007 (KR) ..... 10-2007-0056929

(51) Int. Cl.
*G05D 23/32* (2006.01)

(52) U.S. Cl. ..... 62/179; 62/186; 62/441

(58) Field of Classification Search ..... 62/179, 62/198, 199, 186, 187, 441
See application file for complete search history.

(56) References Cited

U.S. PATENT DOCUMENTS

| | | | | |
|---|---|---|---|---|
| 4,368,622 | A * | 1/1983 | Brooks | 62/157 |
| 5,809,790 | A * | 9/1998 | Kwon | 62/89 |
| 5,896,748 | A * | 4/1999 | Park | 62/179 |
| 6,185,948 | B1 * | 2/2001 | Niki et al. | 62/199 |
| 6,314,746 | B2 * | 11/2001 | Ohya et al. | 62/187 |
| 6,381,982 | B1 * | 5/2002 | Kim | 62/407 |
| 6,598,410 | B2 * | 7/2003 | Temmyo et al. | 62/179 |
| 6,681,584 | B1 * | 1/2004 | Conner | 62/171 |
| 6,725,680 | B1 * | 4/2004 | Schenk et al. | 62/186 |
| 6,935,127 | B2 * | 8/2005 | Jeong et al. | 62/198 |
| 7,127,904 | B2 * | 10/2006 | Schmid | 62/180 |
| 7,533,537 | B2 * | 5/2009 | Rafalovich et al. | 62/199 |
| 2007/0137227 | A1 * | 6/2007 | Konopa | 62/186 |
| 2008/0178621 | A1 * | 7/2008 | Kang | 62/179 |

FOREIGN PATENT DOCUMENTS

| | | |
|---|---|---|
| KR | 1991-0000682 | 1/1991 |
| KR | 1999-005706 | 1/1999 |
| KR | 2001-0061676 | 7/2001 |

* cited by examiner

*Primary Examiner*—George Nguyen
(74) *Attorney, Agent, or Firm*—Staas & Halsey LLP

(57) ABSTRACT

A refrigerator comprises a main cabinet formed with a storage compartment, a partition which partitions the storage compartment into a first storage compartment, a second storage compartment, a multipurpose compartment; a first evaporator provided to the main cabinet to generate cool air supplied to the first storage compartment; a second evaporator which is provided to the main cabinet to generate the cool air supplied to the second storage compartment; a first sub cool air duct which guides the cool air generated from the first evaporator to the multipurpose compartment; a second sub cool air duct which guides the cool air generated from the second evaporator to the multipurpose compartment; and at least one sub cool air supplying apparatus provided to the first sub cool air duct and the second sub cool air duct to supply the cool air from the first evaporator and the second evaporator to the multipurpose compartment.

5 Claims, 6 Drawing Sheets

REFRIGERATOR AND OPERATING METHOD THEREOF

CROSS-REFERENCE TO RELATED APPLICATIONS

This application claims priority from Korean Patent Application No. 10-2007-0056929, filed on Jun. 11, 2007 in the Korean Intellectual Property Office, the disclosure of which is incorporated herein by reference in its entirety.

BACKGROUND

1. Field

A refrigerator and an operating method thereof relate to providing a multipurpose compartment to a partition partitioning a storage compartment into a refrigerating compartment and a freezing compartment, and cooling the multipurpose compartment with cool air generated from a first evaporator and a second evaporator.

2. Description of the Related Art

A refrigerator uses a refrigerating cycle including compressing, condensing and evaporating to store items therein at a low temperature for a long period of time. An inner part of the refrigerator is formed with a storage compartment supplied with cool air generated by the refrigerating cycle, and storing the items. The storage compartment is partitioned, according to the amount of the cool air, into a freezing compartment storing the items below the freezing point, and a refrigerating compartment storing the items at a relatively high temperature, that is, above the freezing point.

Recently, a refrigerator formed with a multi storage compartment capable of extending the freezing compartment and the refrigerating compartment as necessary has been introduced. Also, a refrigerator formed with a multipurpose compartment storing an item under a temperature condition different from the freezing compartment and the refrigerating compartment has been introduced.

However, in the conventional refrigerator, since the multi storage compartment or the multipurpose compartment is cooled by using the evaporator extended from the evaporator cooling the freezing compartment and the refrigerating compartment, the freezing compartment and the refrigerating compartment are overcooled, and manufacturing costs increase. Also, in the conventional refrigerator, since the compressor is excessively operated to cool the multi storage compartment or the multipurpose compartment, operating efficiency of the compressor decreases, and power consumption costs increase.

SUMMARY

Accordingly, it is an aspect of the present invention to provide a refrigerator and an operating method thereof cooling a multipurpose compartment by using cool air of an evaporator generating the cool air supplied to a storage compartment.

Another aspect of the present invention is to provide a refrigerator and an operating method thereof improving operating efficiency of a compressor by using cool air supplied to a refrigerating compartment and a freezing compartment when the temperature of a multipurpose compartment is adjusted.

Still another aspect of the present invention is to provide a refrigerator and an operating method thereof efficiently adjusting the temperature of a multipurpose compartment based on a signal of an evaporator temperature sensor disposed to an evaporator.

Additional aspects and/or advantages of the present invention will be set forth in part in the description which follows and, in part, will be apparent from the description, or may be learned by practice of the present invention.

The foregoing and/or other aspects of the present invention can be achieved by providing a refrigerator comprising: a main body cabinet which is formed with a storage compartment, a partition which partitions the storage compartment into a first storage compartment, a second storage compartment and a multipurpose compartment; a first evaporator which is provided to the main body cabinet to generate cool air which is supplied to the first storage compartment; a second evaporator which is provided to the main body cabinet to generate the cool air which is supplied to the second storage compartment; a first sub cool air duct which guides the cool air which is generated by the first evaporator to the multipurpose compartment; a second sub cool air duct which guides the cool air which is generated by the second evaporator to the multipurpose compartment; and at least one sub cool air supplying apparatus which is provided to the first sub cool air duct and the second sub cool air duct to supply the cool air from the first evaporator and the second evaporator to the multipurpose compartment.

According to an aspect of the invention, the refrigerator further includes: a temperature sensing unit which senses a temperature of the multipurpose compartment, and a control unit which controls an operation of the sub cool air supplying apparatus to adjust the temperature of the multipurpose compartment based on a signal which is generated by the temperature sensing unit.

According to an aspect of the invention, the sub cool air supplying apparatus includes at least one of a damper which is disposed to the first sub cool air duct and the second sub cool air duct to regulate the cool air, and a fan which is disposed to the first sub cool air duct and the second sub cool air duct to blow the cool air to the multipurpose compartment.

According to an aspect of the invention, the refrigerator further includes a first evaporator temperature sensor and a second evaporator temperature sensor which are respectively disposed to the first evaporator and the second evaporator to respectively sense the temperature of the first evaporator and the second evaporator, wherein the control unit controls the sub cool air supplying apparatus based on respective signals of the first evaporator temperature sensor and the second evaporator temperature sensor to supply the cool air from the one of the first evaporator and the second evaporator which has a relatively lower temperature, to the multipurpose compartment.

According to an aspect of the invention, the refrigerator further includes a first evaporator temperature sensor and a second evaporator temperature sensor which are respectively disposed to the first evaporator and the second evaporator to respectively sense the temperature of the first evaporator and the second evaporator, wherein the control unit controls the sub cool air supplying apparatus based on respective signals of the first evaporator temperature sensor and the second evaporator temperature sensor to supply the cool air from the one of the first evaporator and the second evaporator which has a relatively lower temperature, to the multipurpose compartment.

The foregoing and/or other aspects of the present invention can also be achieved by providing an operating method of a refrigerator which includes a main body cabinet which is formed with a storage compartment, a partition which partitions the storage compartment into a first storage compartment, a second storage compartment and a multipurpose compartment; a first evaporator and a second evaporator which are provided to the main body cabinet to generate cool air to the first storage compartment and the second storage compartment respectively; a first sub cool air duct and a second sub cool air duct which supply the cool air which is generated from the first evaporator and the second evaporator to the multipurpose compartment; a first sub cool air supplying apparatus and a second sub cool air supplying apparatus which are respectively provided to the first sub cool air duct and the second sub cool air duct; and a temperature sensing unit which senses a temperature of the multipurpose compartment, the operating method of the refrigerator including: sensing the temperature of the multipurpose compartment with the temperature sensing unit; and operating at least one of the first sub cool air supplying apparatus and the second sub cool air supplying apparatus to supply the cool air to the multipurpose compartment based on the temperature which is sensed by the temperature sensing unit.

According to an aspect of the invention, the refrigerator further includes a first evaporator temperature sensor and a second evaporator temperature sensor which are respectively disposed to the first evaporator and the second evaporator to respectively sense the temperatures of the first evaporator and the second evaporator, and the operating method of the refrigerator further includes supplying the multipurpose compartment with the cool air from the one of the first evaporator and the second evaporator which has a relatively lower temperature, based on the temperature which is sensed by the first evaporator temperature sensor and the second evaporator temperature sensor.

According to an aspect of the invention, the operating method of the refrigerator further includes controlling operations of one of the first sub cool air supplying apparatus and the second sub cool air supplying apparatus which corresponds to the evaporator which has a relatively lower temperature.

BRIEF DESCRIPTION OF THE DRAWINGS

These and/or other aspects and advantages of the present invention will become apparent and more readily appreciated from the following description of the embodiments, taken in conjunction with the accompanying drawings, in which.

DETAILED DESCRIPTION OF THE EMBODIMENTS

Figure 1:
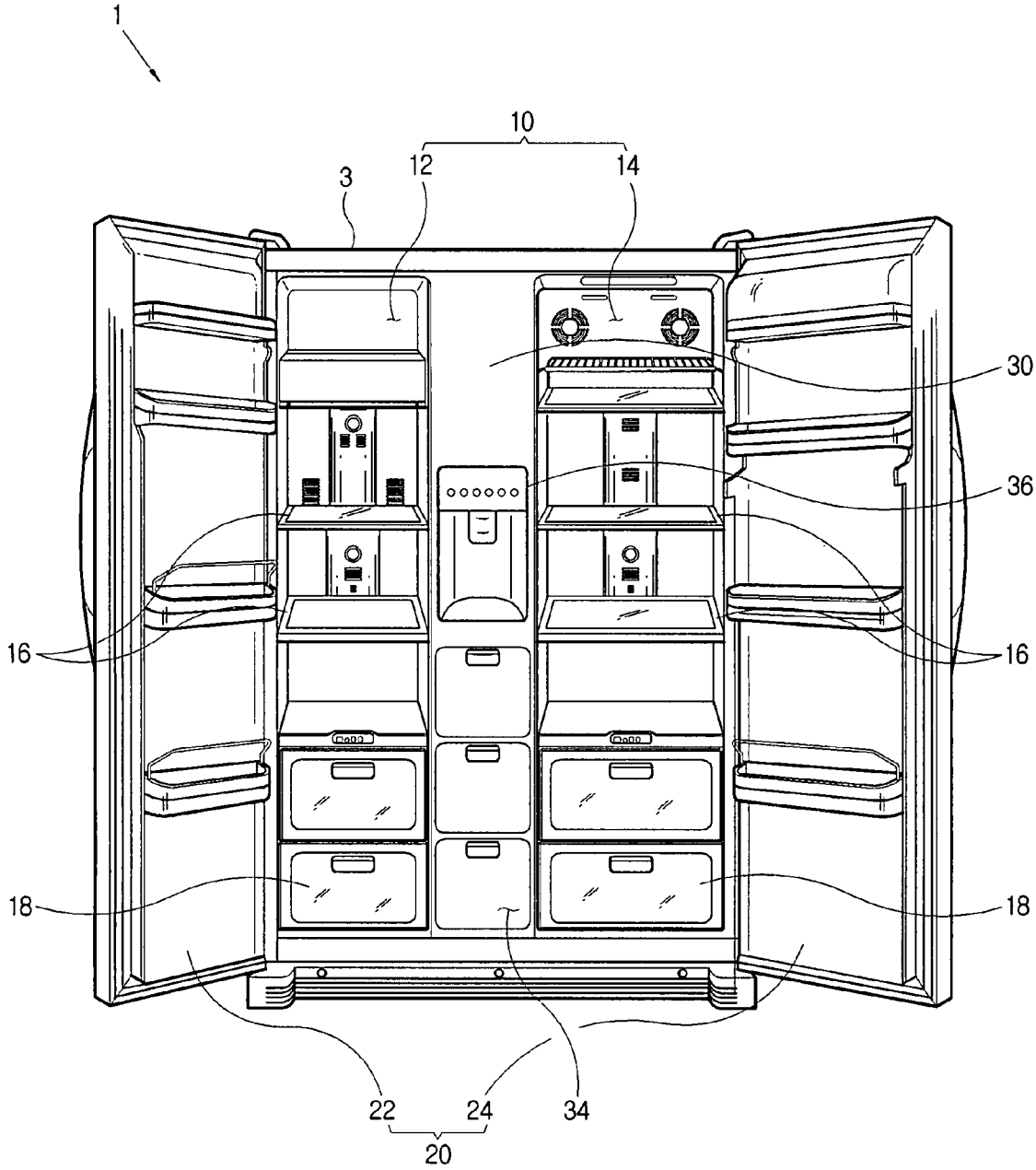
FIG. 1 is a perspective view of a refrigerator according to a first embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
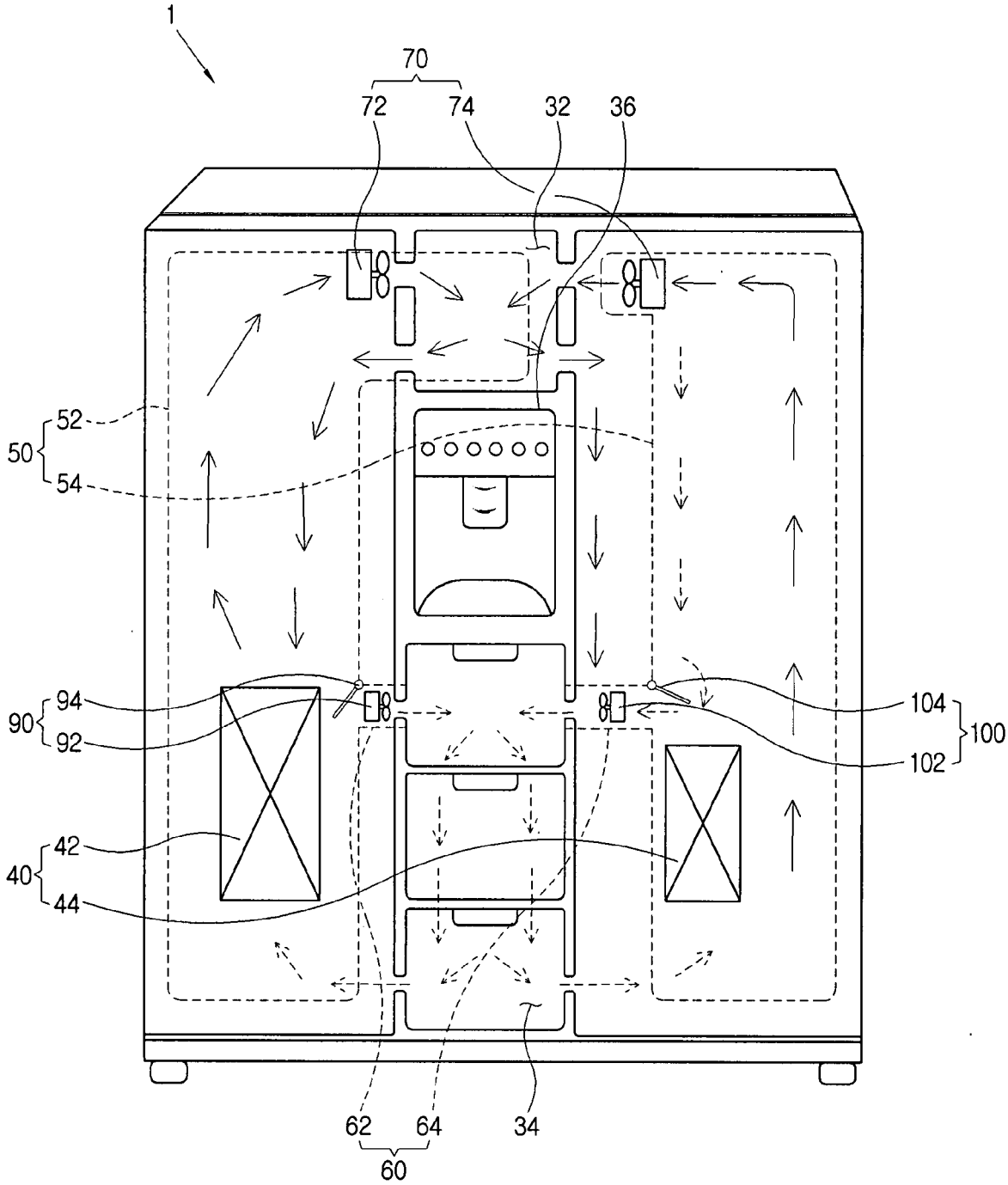
FIG. 2 is a schematic diagram illustrating the supply of a multipurpose compartment with cool air from a first evaporator and a second evaporator of the refrigerator according to the first embodiment of the present invention.

FIG. 1 is a perspective view of a refrigerator according to a first exemplary embodiment of the present invention, and FIG. 2 is a schematic diagram illustrating the supply of a multipurpose compartment with cool air from a first evaporator and a second evaporator of the refrigerator according to the first embodiment of the present invention. As shown therein, a refrigerator 1 according to the first embodiment of the present invention includes a main body cabinet 3 formed with a storage compartment 10, and a partition 30 formed with a multipurpose compartment 34.

The main body cabinet 3 forms an external appearance of the refrigerator 1, and forms the storage compartment 10 in an inner part thereof. The main body cabinet 3 includes a compressor 5, a condenser (not shown) and an evaporator 40. Here, an area of the main body cabinet 3 is formed with a machine room (not shown) partitioned from a space to which the evaporator 40 is disposed, and accommodating the compressor 5 and the condenser. Also, an inner part of the main body cabinet 3 is provided with a cool air duct 50 guiding cool air generated from the evaporator 40 to the storage compartment 10, and a sub cool air duct 60 guiding the cool air to the multipurpose compartment 34. The cool air duct 50 is provided with a blowing fan 70 guiding the cool air to the storage compartment 10, and a damper (not shown), and the sub cool air duct 60 is provided with a sub cool air supplying apparatus 80 in FIG. 5, guiding the cool air to the multipurpose compartment 34.

The storage compartment is divided by the partition 30 into a freezing compartment 12 storing items under the freezing point, and a refrigerating compartment 14 storing the items at a higher temperature relative to the temperature of the freezing compartment 12, that is, above the freezing point. A shelf 16 partitioning a space of the storage compartment 10 into a plurality of spaces, and an accommodating case 18 storing items such as vegetables which require higher moisture are disposed inside the storage compartment 10. Also, the storage compartment 10 is opened and closed by a door 20 coupled to the main body cabinet 3. Here, the door 20 includes a freezing compartment door 22 opening and closing the freezing compartment 12, and a refrigerating compartment door 24 opening and closing the refrigerating compartment 14.

The partition 30 is provided inside the main body cabinet 3 in a standing direction of the main body cabinet 3. The partition 30 has a predetermined width in a transverse direction to the standing direction of the main body cabinet 3. As an exemplary embodiment of the present invention, an ice making compartment 32 generating ice is formed on an upper part of the partition 30, and the multipurpose compartment 34 is formed on a lower part of the partition 30. Also, a dispenser unit 36 is disposed to a central area of the partition 30, that is, between the ice making compartment 32 and the multipurpose compartment 34.

The multipurpose compartment 34 is provided between the freezing compartment 12 and the refrigerating compartment 14, and is slidingly opened and closed by a drawer type door.

The multipurpose compartment 34 is supplied with cool air generated from a first evaporator 42 and a second evaporator 44. The cool air supplied to the multipurpose compartment 34 is guided by the sub cool air duct 60.

The evaporator 40 according to an exemplary embodiment of the present invention includes the first evaporator 42 provided adjacent to the freezing compartment 12 to generate the cool air to be supplied to the freezing compartment 12, and the second evaporator 44 provided adjacent to the refrigerating compartment 14 to generate the cool air to be supplied to the refrigerating compartment 14. In the present embodiment, the first evaporator 42 has a bigger size than the second evaporator 44 to increase the amount of the generated cool air. The first evaporator 42 and the second evaporator 44 are respectively disposed inside the cool air duct 50.

The first evaporator 42 and the second evaporator 44 according to the present embodiment respectively supply the cool air to the freezing compartment 12 and the refrigerating compartment 14. Alternatively, the first evaporator 42 and the second evaporator 44 may be respectively disposed to areas of the refrigerating compartment 12 and the freezing compartment 14.

Figure 3:
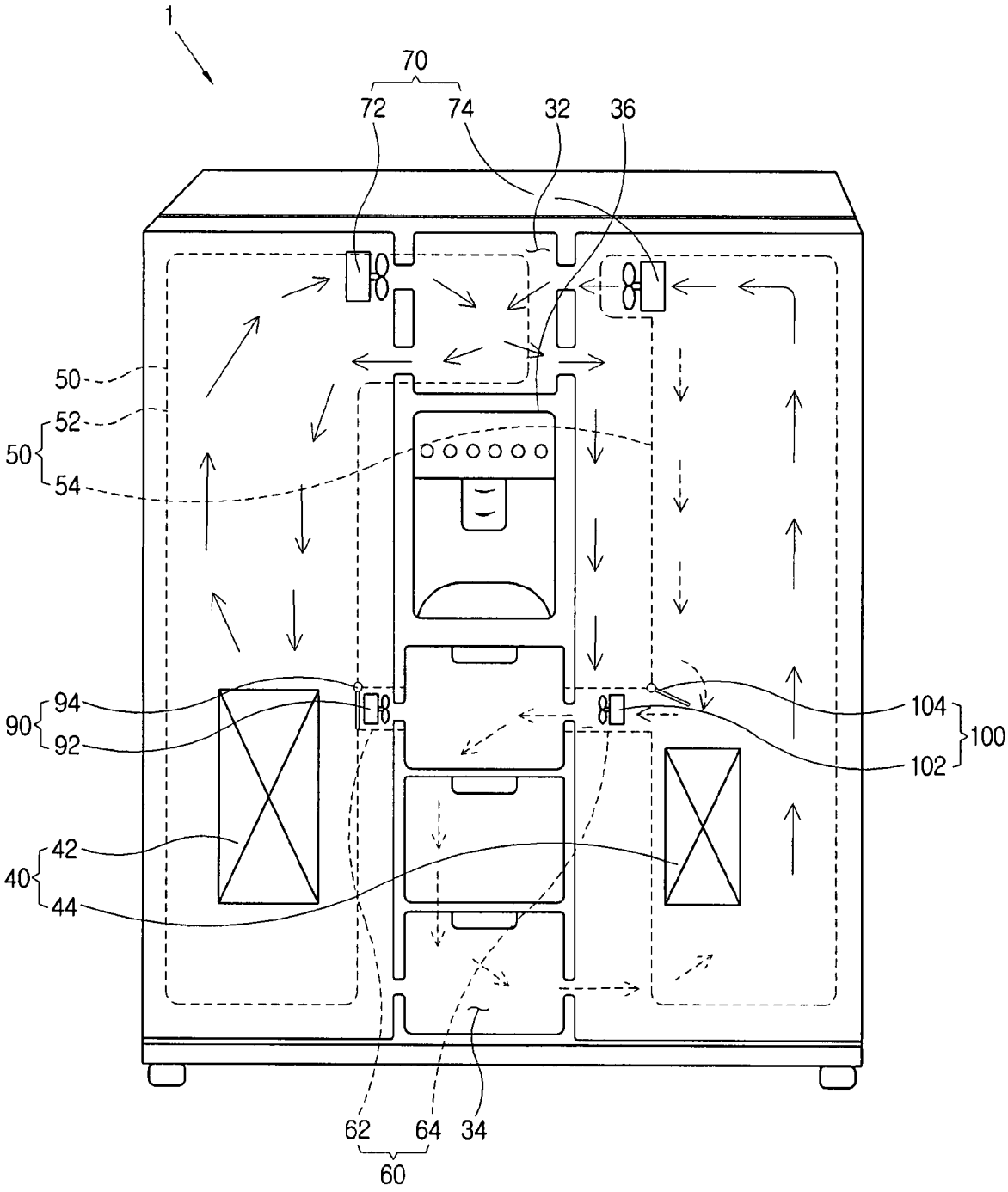
FIG. 3 is a schematic diagram illustrating the supply of the multipurpose compartment with cool air from the first evaporator of the refrigerator according to the first embodiment of the present invention.
Figure 4:
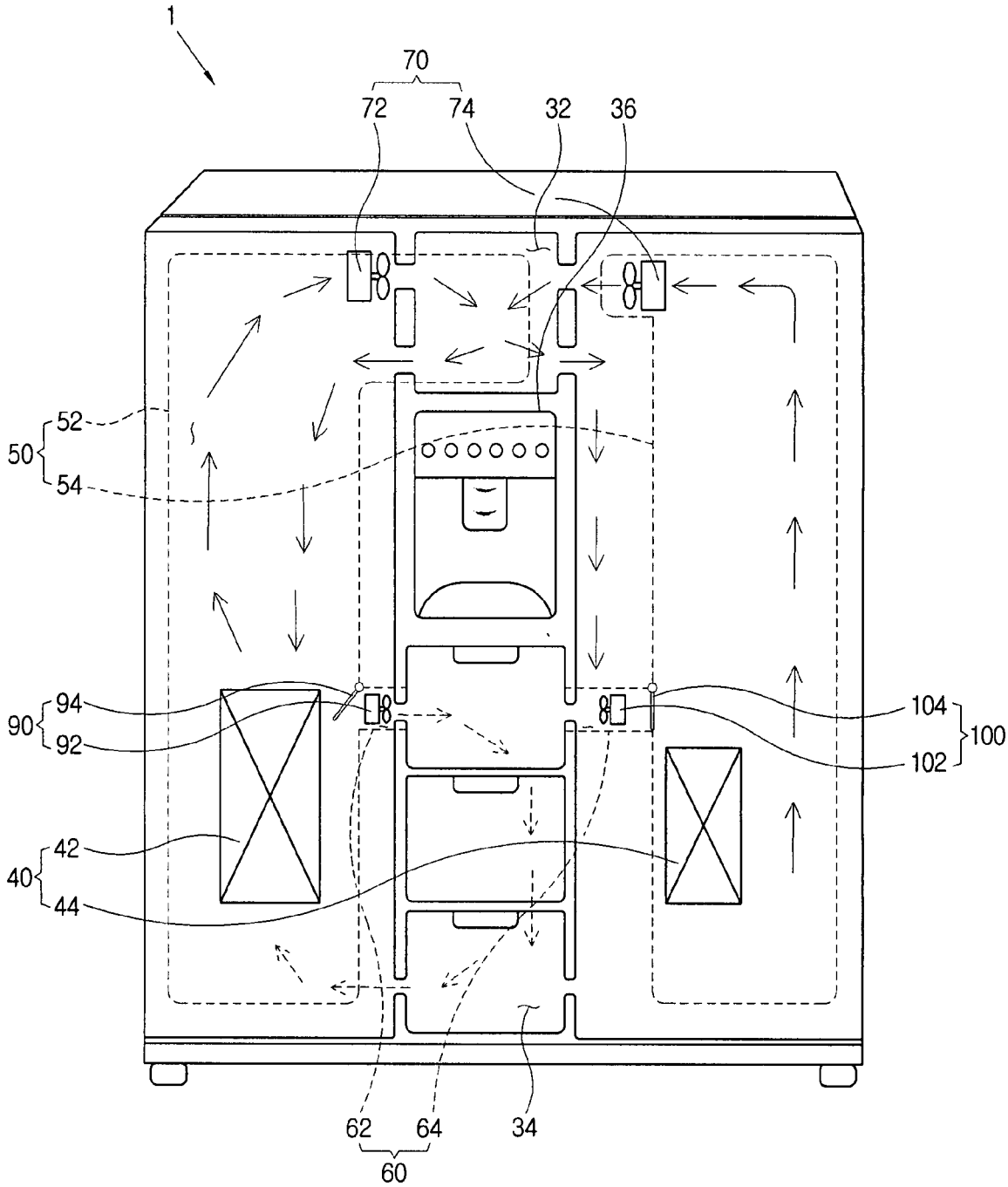
FIG. 4 is a schematic diagram illustrating the supply of the multipurpose compartment with cool air from the second evaporator of the refrigerator according to the first embodiment of the present invention.

As shown in FIGS. 3 and 4, the cool air duct 50 is formed with a cool air channel to respectively guide the cool air generated from the first evaporator 42 and the second evaporator 44 to the freezing compartment 12 and the refrigerating compartment 14. The cool air duct 50 is exemplarily partitioned into a first cool air duct 52 accommodating the first evaporator 42, and a second cool air duct 54 accommodating the second evaporator 44. Here, the first cool air duct 52 and the second cool air duct 54 accommodate the first evaporator 42 and the second evaporator 44 respectively, and the cool air flowing into the freezing compartment 12 and the refrigerating compartment 14 is regulated by a damper (not shown) disposed within the cool air duct 50.

The sub cool air duct 60 according to the present exemplary embodiment communicates with the first evaporator 42 and the second evaporator 44 to guide the cool air generated from the first evaporator 42 and the second evaporator 44 to the multipurpose compartment 34. That is, the sub cool air duct 60 forms a sub cool air channel between the first and second evaporators 42 and 44 and the multipurpose compartment 34 to guide flow of the cool air generated from the first evaporator 42 and the second evaporator 44 to the multipurpose compartment 34. Here, the sub cool air duct 60 includes a first sub cool air duct 62 forming the sub cool air channel between the first evaporator 42 and the multipurpose compartment 34, and a second sub cool air duct 64 forming the sub cool air channel between the second evaporator 44 and the multipurpose compartment 34.

The blowing fan 70 is disposed on the cool air channel. The blowing fan 70 includes a first blowing fan 72 blowing the cool air generated from the first evaporator 42 to the freezing compartment 12, and a second blowing fan 74 blowing the cool air generated from the second evaporator 44 to the refrigerating compartment 14. For example, the respective blowing fans 70 are disposed on the cool air channel to blow the cool air flowing through the cool air channel to the freezing compartment 12 and the refrigerating compartment 14.

The sub cool air supplying apparatus 80 is provided in the sub cool air duct 60 to guide the cool air generated from the first evaporator 42 and the second evaporator 44 to the multipurpose compartment 34. The sub cool air supplying apparatus 80 includes a first sub cool air supplying apparatus 90 disposed in the first sub cool air duct 62, and a second sub cool air supplying apparatus 100 disposed in the second sub cool air duct 64. Here, in the first sub cool air supplying apparatus 90 and the second sub cool air supplying apparatus 100 according to the present exemplary embodiment, a first fan 92 and a second fan 102 blowing the cool air to the multipurpose compartment 34, and a first damper 94 and a second damper 104 regulating flow of the cool air to the multipurpose compartment 34 are disposed. The first sub cool air supplying apparatus 90 and the second sub cool air supplying apparatus 100 according to the present exemplary embodiment include the first fan 92 and the first damper 94, and the second fan 94 and the second damper 104 respectively. Alternatively, the first sub cool air supplying apparatus 90 and the second sub cool air supplying apparatus 100 may respectively include one of the first fan 92 and the first damper 94, and one of the second fan 102 and the second damper 104.

The first fan 92 and the second fan 102 are respectively disposed to the first sub cool air duct 62 and the second sub cool air duct 64 to blow the cool air generated from the first evaporator 42 and the second evaporator 44 to the multipurpose compartment 34. Here, the first damper 94 and the second damper 104 are disposed inside the first sub cool air duct 62 and the second sub cool air duct 64 to be adjacent to the first fan 92 and the second fan 102. For example, the first damper 94 is disposed inside the first sub cool air duct 62 communicating with the first evaporator 42 to regulate the cool air generated from the first evaporator 42, and the second damper 104 is disposed inside the second sub cool air duct 64 communicating with the second evaporator 44 to regulate the cool air generated from the second evaporator 44.

Figure 5:
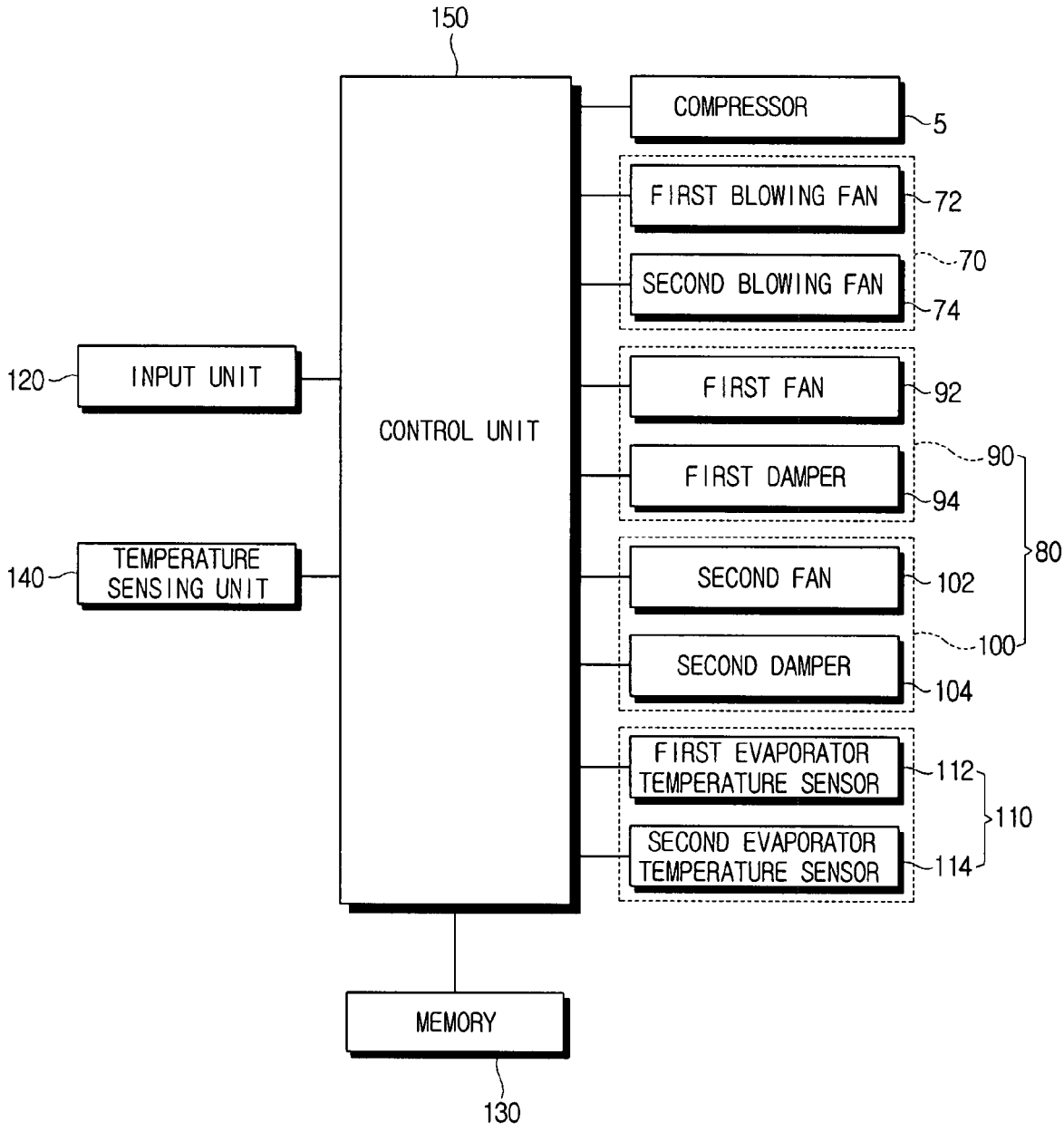
FIG. 5 is a control block diagram of the refrigerator according to the first embodiment of the present invention.

As shown in FIG. 5, the refrigerator 1 according to the first embodiment of the present invention further includes an evaporator temperature sensor 110 sensing the temperature of the first evaporator 42 and the second evaporator 44, an input unit 120 receiving an operating signal of the refrigerator 1, a memory 130 storing the operating signal inputted from the input unit 120, a temperature sensing unit 140 sensing the temperature of the multipurpose compartment 34, and a control unit 150 controlling an operation of the sub cool air supplying apparatus 80 to adjust the temperature of the multipurpose compartment 34 based on a signal sensed by the temperature sensing unit 140.

The evaporator temperature sensor 110 includes a first evaporator temperature sensor 112 disposed to the first evaporator 42 to sense the temperature of the first evaporator 42, and a second evaporator temperature sensor 114 disposed to the second evaporator 44 to sense the temperature of the second evaporator 44. The evaporator temperature sensor 110 may mainly sense the temperature during operation of the compressor 5, and the temperature during defrosting.

The input unit 120 is provided to a front surface of the refrigerator 1 to receive the operating signal from a user. The input unit 120 according to the present embodiment of the present invention is provided to the dispenser unit 36. Alternatively, the input unit 120 may be provided to another part of the front surface of the refrigerator 1. The input unit 120 receives reference temperatures of the freezing compartment 12, the refrigerating compartment 14 and the multipurpose compartment 34.

The memory 130 stores the signal inputted from the input unit 120. For example, if the input unit 120 receives −12° for the reference temperature of the freezing compartment 12, 4° for the reference temperature of the refrigerating compartment 14, and 6° for the reference temperature of the multipurpose compartment 34, the inputted reference temperatures are stored in the memory 130. The control unit 150 compares temperature data sensed by a freezing compartment temperature sensing unit (not shown), a refrigerating compartment temperature sensing unit (not shown) and the temperature sensing unit 140 with the reference temperatures stored in the memory 130.

The control unit 150 controls an operation of the compressor 5 based on the signals sensed by the freezing compartment temperature sensing unit, the refrigerating compartment temperature sensing unit and the temperature sensing unit 140 to generate the cool air.

The control unit 150 according to the present embodiment of the present invention controls the operation of the sub cool air supplying apparatus 80 to adjust the temperature of the multipurpose compartment 34 based on the signal sensed by the temperature sensing unit 140. For example, when rapidly decreasing the temperature of the multipurpose compartment 34, the control unit 150 increases rotation numbers of the first fan 92 and the second fan 102 disposed to the first sub cool air duct 62 and the second sub cool air duct 64 to allow a large amount of cool air to be supplied to the multipurpose compartment 34 in a short period of time. On the other hand, when increasing or minutely decreasing the temperature of the multipurpose compartment 34, the control unit 150 decreases the number of rotations of the first fan 92 and the second fan 102 to decrease the amount of the cool air supplied to the multipurpose compartment 34. Alternatively, when adjusting the temperature of the multipurpose compartment 34 by a minute difference (i.e., 1°), the control unit 150 may operate only a corresponding fan so that the cool air generated from either the first evaporator 42 or the second evaporator 44 can be supplied to the multipurpose compartment 34.

The control unit 150 controls operation of the first damper 94 and the second damper 104 respectively disposed to the first sub cool air duct 62 and the second sub cool air duct 64. The control unit 150 controls the first damper 94 and the second damper 104 to open all sub cool air channels when the first fan 92 and the second fan 102 are concurrently operated.

Also, to improve a cooling efficiency, the control unit 150 controls the operation of the sub cool air supplying apparatus 80 based on the signals of the first evaporator temperature sensor 112 and the second evaporator temperature sensor 114 so that the multipurpose compartment 34 can be supplied with the cool air from one of the first evaporator 42 and the second evaporator 44 which has a relatively lower temperature. For example, after the compressor 5 has stopped its operation, the control unit 150 compares sensed signals transmitted from the first evaporator temperature sensor 112 and the second evaporator temperature sensor 114 therebetween. Then, if the temperature of the first evaporator 42 is determined to be lower than the temperature of the second evaporator 44, the control unit 150 operates the first sub cool air supplying apparatus 90 provided to the first sub cool air duct 62 connected with the first evaporator 42 to control the temperature of the multipurpose compartment 34.

That is, the control unit 150 controls the operation of the sub cool air supplying apparatus 80 to efficiently adjust the temperature of the multipurpose compartment 34 by using the cool air from the first evaporator 42 and the second evaporator 44 by the signals transmitted from the first evaporator temperature sensor 112 and the second evaporator temperature sensor 114 respectively disposed to the first evaporator 42 and the second evaporator 44.

With this configuration, an operation of supplying the cool air to the multipurpose compartment 34 will be described. The operation includes an operation of supplying the cool air to the multipurpose compartment 34 from the first evaporator 42 and the second evaporator 44, an operation of supplying the cool air to the multipurpose compartment 34 from the first evaporator 42, and an operation of supplying the cool air to the multipurpose compartment 34 from the second evaporator 44.

First, the operation process of supplying the cool air to the multipurpose compartment 34 from the first evaporator 42 and the second evaporator 44 will be described by referring to FIG. 2.

If the reference temperatures of the freezing compartment 12, the refrigerating compartment 14 and the multipurpose compartment 34 are input to the input unit 120, the control unit 150 operates the compressor 5 to supply the cool air to the freezing compartment 12 and the refrigerating compartment 14. The cool air respectively generated from the first evaporator 42 and the second evaporator 44 is guided to the cool air duct 50, and the cool air guided to the cool air duct 50 is respectively sent to the freezing compartment 12 and the refrigerating compartment 14 by the first blowing fan 72 and the second blowing fan 74 as illustrated by solid line arrows.

Here, if the first damper 94 and the second damper 104 disposed on the sub cool air duct 60 are operated to open the first sub cool air duct 62 and the second sub cool air duct 64, the cool air generated from the first evaporator 42 and the second evaporator 44 is guided to the first sub cool air duct 62 and the second sub cool air duct 64. The cool air guided to the first sub cool air duct 62 and the second sub cool air duct 64 is sent to the multipurpose compartment 34 by the operation of the first fan 92 and the second fan 102 disposed adjacent to the first damper 94 and the second damper 104, as illustrated by dotted line arrows.

Also, as shown in FIGS. 3 and 4, the first sub cool air supplying apparatus 90 and the second sub cool air supplying apparatus 100 may be alternately operated based on the signals sensed by the first evaporator temperature sensor 112 and the second evaporator temperature sensor 114 disposed to the first evaporator 42 and the second evaporator 44.

Accordingly, by disposing the sub cool air supplying apparatus so that the cool air generated in the first evaporator and the second evaporator can be supplied to the multipurpose compartment to control the temperature of the multipurpose compartment, the cooling efficiency of the multipurpose compartment can be improved.

Also, a separate operation of the compressor is unnecessary to cool the multipurpose compartment by using the cool air generated in the first evaporator and the second evaporator in adjusting the temperature of the multipurpose compartment, thereby improving an operating efficiency of the compressor and reducing a power consumption cost.

Also, by controlling the operation of the sub cool air supplying apparatus based on the signal of the evaporator temperature sensors respectively disposed to the first evaporator and the second evaporator, the temperature of the multipurpose compartment can be more efficiently adjusted.

Figure 6:
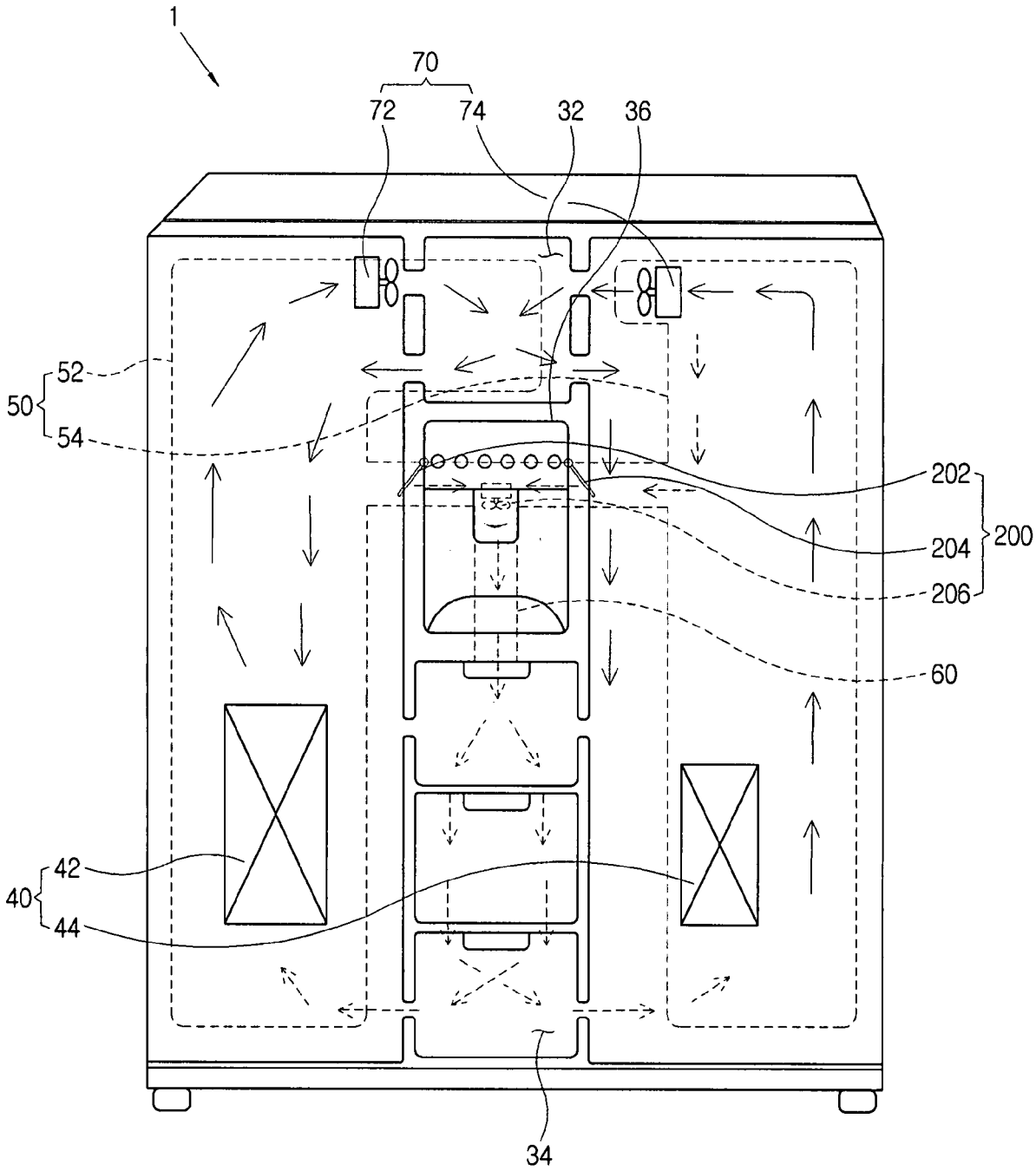
FIG. 6 is a schematic configuration diagram of a sub cool air supplying apparatus of a refrigerator according to a second embodiment of the present invention.

As shown in FIG. 6, the sub cool air duct 60 communicating with the first cool air duct 52 and the second cool air duct 54 is provided, and a sub cool air supplying apparatus 200 provided to the sub cool air duct 60 to include a first damper 202 regulating the cool air supplied from the first cool air duct 52 to the sub cool air duct 60, a second damper 204 regulating the cool air supplied from the second cool air duct 54 to the sub cool air duct 60, and a fan 206 blowing the cool air supplied to the sub cool air duct 60 to the multipurpose compartment 34 is operated, thereby controlling the temperature of the multipurpose compartment 34.

As described above, the embodiments of the present invention provide a refrigerator and an operating method thereof disposing a sub cool air supplying apparatus so that cool air generated in a first evaporator and a second evaporator can be supplied to a multipurpose compartment to control the temperature of the multipurpose compartment, thereby improving a cooling efficiency of the multipurpose compartment.

Also, in a refrigerator and an operating method thereof, a separate operation of a compressor is unnecessary to cool a multipurpose compartment by using cool air generated in a first evaporator and a second evaporator in adjusting the temperature of the multipurpose compartment, thereby improving an operating efficiency of the compressor and reducing a power consumption cost.

Also, the embodiments of the present invention provide a refrigerator and an operating method thereof controlling an operation of a sub cool air supplying apparatus based on a signal of an evaporator temperature sensor respectively disposed to a first evaporator and a second evaporator so that the temperature of a multipurpose compartment can be more efficiently adjusted.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a main body cabinet which is formed with a storage compartment;

a partition which partitions the storage compartment into a first storage compartment, a second storage compartment and a multipurpose compartment;

a first evaporator which is provided to the main body cabinet to generate cool air which is supplied to the first storage compartment;

a second evaporator which is provided to the main body cabinet to generate cool air which is supplied to the second storage compartment;

a first sub cool air duct which guides the cool air which is generated by the first evaporator to the multipurpose compartment;

a second sub cool air duct which guides the cool air which is generated by the second evaporator to the multipurpose compartment; and at least one sub cool air supplying apparatus which is provided to the first sub cool air duct and the second sub cool air duct to supply the cool air from the first evaporator and the second evaporator to the multipurpose compartment; and further comprising a first evaporator temperature sensor and a second evaporator temperature sensor which are respectively disposed to the first evaporator and the second evaporator to respectively sense the temperature of the first evaporator and the second evaporator, wherein the control unit controls the sub cool air supplying apparatus based on respective signals of the first evaporator temperature sensor and the second evaporator temperature sensor to supply the cool air from the one of the first evaporator and the second evaporator which has a relatively lower temperature, to the multipurpose compartment.

2. The refrigerator according to claim 1, further comprising:

a temperature sensing unit which senses a temperature of the multipurpose compartment, and a control unit which controls an operation of the sub cool air supplying apparatus to adjust the temperature of the multipurpose compartment based on a signal which is generated by the temperature sensing unit.

3. The refrigerator according to claim 2, wherein the sub cool air supplying apparatus comprises:

at least one of a damper which is disposed to the first sub cool air duct and the second sub cool air duct to regulate the cool air, and a fan which is disposed to the first sub cool air duct and the second sub cool air duct to blow the cool air to the multipurpose compartment.

4. An operating method of a refrigerator comprising:

a main body cabinet which is formed with a storage compartment;

a partition which partitions the storage compartment into a first storage compartment, a second storage compartment and a multipurpose compartment;

a first evaporator and a second evaporator which are provided to the main body cabinet to generate cool air to the first storage compartment and the second storage compartment respectively;

a first sub cool air duct and a second sub cool air duct which supply the cool air which is generated from the first evaporator and the second evaporator to the multipurpose compartment;

a first sub cool air supplying apparatus and a second sub cool air supplying apparatus which are respectively provided to the first sub cool air duct and the second sub cool air duct; and a temperature sensing unit which senses a temperature of the multipurpose compartment, the operating method of the refrigerator comprising:

sensing the temperature of the multipurpose compartment with the temperature sensing unit; and operating at least one of the first sub cool air supplying apparatus and the second sub cool air supplying apparatus to supply the cool air to the multipurpose compartment based on the temperature which is sensed by the temperature sensing unit; and wherein the refrigerator further comprises a first evaporator temperature sensor and a second evaporator temperature sensor which are respectively disposed to the first evaporator and the second evaporator to respectively sense the temperatures of the first evaporator and the second evaporator, and the operating method of the refrigerator further comprises supplying the multipurpose compartment with the cool air from the one of the first evaporator and the second evaporator which has a relatively lower temperature, based on the temperature which is sensed by the first evaporator temperature sensor and the second evaporator temperature sensor.

5. The operating method of the refrigerator according to claim 4, further comprising controlling one of the first sub cool air supplying apparatus and the second sub cool air supplying apparatus which corresponds to the evaporator which has a relatively lower temperature.

* * * * *